US011058966B2

(12) United States Patent
Jennings et al.

(10) Patent No.: US 11,058,966 B2
(45) Date of Patent: Jul. 13, 2021

(54) SUSPENDED THEATER WITH EDGE ACTUATORS

(71) Applicant: Oceaneering International, Inc., Houston, TX (US)

(72) Inventors: Clifford Allen Jennings, Highland, MD (US); Kenneth Kurtz, Wellington, FL (US); Justin Quillen, Groveland, FL (US); Jeremy Wall, Windermere, FL (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 16/846,044

(22) Filed: Apr. 10, 2020

(65) Prior Publication Data

US 2020/0324219 A1 Oct. 15, 2020

Related U.S. Application Data

(60) Provisional application No. 62/832,763, filed on Apr. 11, 2019.

(51) Int. Cl.

| | |
|---|---|
| ***A63J 5/00*** | (2006.01) |
| ***A63G 31/02*** | (2006.01) |
| ***A63J 25/00*** | (2009.01) |
| ***E04H 3/30*** | (2006.01) |
| ***A47C 1/12*** | (2006.01) |
| ***A47C 1/124*** | (2006.01) |

(Continued)

(52) U.S. Cl.

CPC *A63J 5/00* (2013.01); *A47C 1/12* (2013.01); *A47C 1/124* (2013.01); *A63G 31/02* (2013.01); *A63G 31/16* (2013.01); *A63J 3/00* (2013.01); *A63J 5/12* (2013.01); *A63J 25/00* (2013.01); *E04H 3/30* (2013.01); *A63G 27/02* (2013.01); *A63J 2005/002* (2013.01)

(58) Field of Classification Search

CPC ..... A63G 31/00; A63G 31/02; A63G 31/16; A63J 5/00; A63J 25/00; A04J 3/00; A04J 3/30; A47C 1/00; A47C 1/12

USPC ..... 472/59, 69, 61, 130, 136; 52/8–10; 434/29, 55

See application file for complete search history.

(56) References Cited

U.S. PATENT DOCUMENTS 8,721,464 B2 * 5/2014 Ou Yang ..... A63G 31/16 472/59

8,864,593 B2 * 10/2014 Gil ..... A47C 11/005 472/59

(Continued)

*Primary Examiner* — Kien T Nguyen

(74) *Attorney, Agent, or Firm* — Maze IP Law, P.C.

(57) ABSTRACT

A suspended theater system uses a seat moving machine comprising a passenger seat assembly disposed in between opposing seat supports which raise and lower the passenger seat assembly. One or more passenger seat beam rotators are operative to rotate the passenger seat assembly to change the pitch independently of the raising and lowering. In embodiments, rather that the seat rows being pivoted up with a rotating floor, a rotate function alters their mutual positions to one another while the lift function is taking place which brings the back seat rows up and over the front seat rows, allowing control over mutual row position during lift and in the show. Though no cables are involved, by combining the motions of lift and rotate and without any further equipment, an immersive theater system comprising the seat moving machine still employs seating that is suspended.

14 Claims, 11 Drawing Sheets

(51) Int. Cl.

| | |
|---|---|
| ***A63G 31/16*** | (2006.01) |
| ***A63J 3/00*** | (2006.01) |
| ***A63J 5/12*** | (2006.01) |
| *A63G 27/02* | (2006.01) |

(56) References Cited

U.S. PATENT DOCUMENTS

| | | | | |
|---|---|---|---|---|
| 9,511,299 | B1 * | 12/2016 | Lai | A63G 31/02 |
| 9,540,831 | B2 * | 1/2017 | Koch | E04H 3/30 |
| 2015/0141162 | A1 * | 5/2015 | Fox | E04H 3/22<br>472/75 |
| 2015/0273348 | A1 * | 10/2015 | Job | E04H 3/30<br>472/59 |
| 2016/0325201 | A1 * | 11/2016 | Li | E04H 3/30 |

* cited by examiner

SUSPENDED THEATER WITH EDGE ACTUATORS

RELATION TO OTHER APPLICATIONS

This application claims priority through U.S. Provisional Application 62/832,763 filed on Apr. 11, 2019.

BACKGROUND

Motion theaters, of many design forms, physically move the guest from a starting/loading position into a projected show environment, with the objective primarily being the sensation of immersion into that environment.

Many suspended theater designs, up to this point, have been based on a literal suspension of seating apparatus, usually by way of cables, counterweights and winches, and usually from an overhead framework and set of sheaves. Other related products, commonly referred to as "flying theaters," frequently rely on a moving overhead frame or pivoting floor which translates the seats into the theater environment.

FIGURES

Various figures are included herein which illustrate aspects of embodiments of the disclosed inventions.

DESCRIPTION OF EXEMPLARY EMBODIMENTS

In general, as will be understood by one of ordinary skill in theater seating arts especially for immersive theaters, instead of equipment being above guests, which increases facility height and safety issues, or beneath guests, which also increases facility height, the theater seating assemblies claimed herein lift left and right sides of seat rows by using left and right versions of two otherwise identical machines, as described herein. The result of this arrangement can minimize facility height.

Moreover, in the described embodiments, rather than the seat rows being pivoted up with a rotating floor, a second function alters their mutual positions relative to one another while the lift function is taking place such as by rotation. This rotate function brings the back seat rows up and over the front seat rows, allowing control over mutual row position during lift and in the show. The rotate function can also allow the seat rows to flatten out, front to back, in order to "hop" over a lower theater screen or wall during lift, and then achieve their final vertical relationship once past that hurdle.

Figure 1:
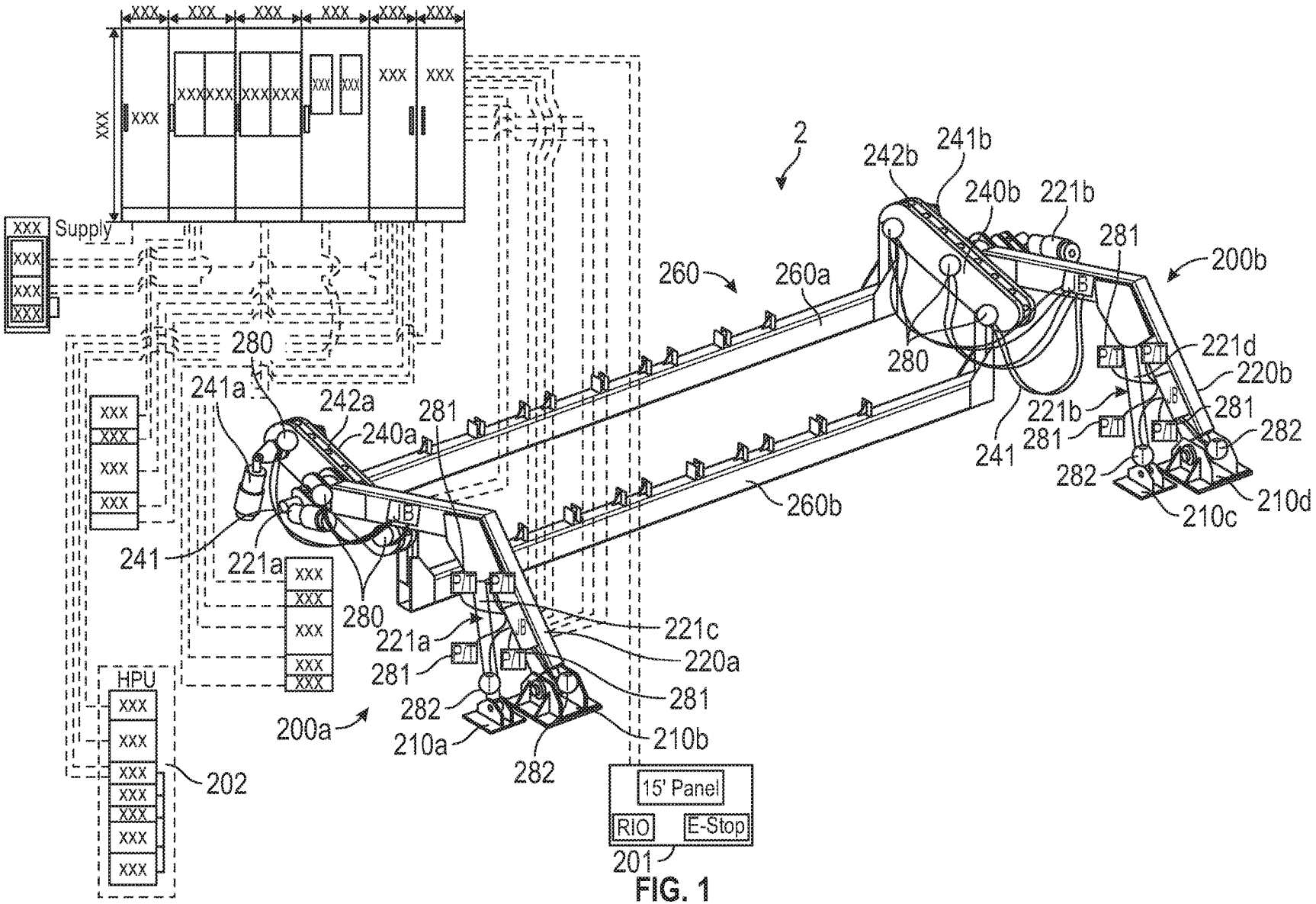
FIG. 1 is a block diagram of a first embodiment of the invention.

In a first embodiment, referring generally to FIG. 1, theater seating assembly 1 typically comprises one or more seat support bases 210*a*, 210*b*, 210*c*, 201*d*; first seat support 200*a*; second seat support 200*b* disposed distally from the first seat support 200*a* along seat support bases 210*a*, 210*b*, 210*c*, 201*d* in a mirror configuration with respect to a seat axis defined by a longitudinal distance between first seat support 200*a* and second seat support 200*b*; passenger seat assembly 260 operatively connected to first passenger seat beam rotator 240*a* and to second passenger seat beam rotator 240*b* where passenger seat assembly 260 is disposed substantially parallel to the seat axis and comprises a passenger seating area (such as callout 163 in FIG. 2); and one or more system controllers 201,202 operatively in communication with first lift arm actuator 221*a*, second lift arm actuator 221*b*, first passenger seat beam rotator actuator 241*a*, and second passenger seat beam rotator actuator 241*b*.

First seat support 200*a* comprises first lift arm 220*a* pivotally connected to seat support base 210*a*, 210*b*; first lift arm actuator 221*a* operatively, and typically pivotally, connected to first lift arm 220*a* and to seat support base 210*a*, 210*b*, typically pivotally; first passenger seat beam rotator 240*a* operatively, and typically pivotally, connected to first lift arm 220*a* distally from seat support base 210*a*, 210*b*, 210*c*, 210*d*; and first passenger seat beam rotator actuator 241*a* operatively connected to first passenger seat beam rotator 240*a*. First passenger seat beam rotator actuator 241*a* is operative to effect a change in passenger seat row pitch independently of rotation of first lift arm 220*a*.

Second seat support 200*b* typically mirrors first seat support 200*a* and comprises second lift arm 220*b* which is pivotally connected to seat support base 210*c*, 210*d*; second lift arm actuator 221*b* which is operatively, and typically pivotally, connected to second lift arm 220*b* and to seat support base 210*c*, 201*d*, and typically pivotally, where second lift arm actuator 221*b* is configured to coordinate movement of second lift arm 220*b* with movement of first lift arm 220*a*; second passenger seat beam rotator 240*b* which is operatively connected to second lift arm 220*b*, typically pivotally; and second passenger seat beam rotator actuator 241*b* which is operatively connected to second passenger seat beam rotator 240*b* distally from the seat support base 210*c*, 210*d*. Second passenger seat beam rotator actuator 241*b* is also operative to effect a change in passenger seat row pitch independently of rotation of second lift arm 220*b* cooperatively with first passenger seat beam rotator actuator 241*a*.

A first X-Y plane is defined by seat support base 210*a*, 201*b* and first lift arm 220*a* and a second X-Y plane is defined by seat support base 210*c*, 210*d* and second lift arm 220*b* where the second X-Y plane is substantially parallel to the first X-Y plane.

In this first embodiment, first lift arm 220*a* may comprise a lower portion and an upper portion disposed at an angular offset from the lower portion and second lift arm 220*b* is substantially identical to first lift arm 220*a*.

Typically, in this first embodiment, first passenger seat beam rotator 240*a* is pivotally connected to first lift arm 220*a* at a pivot point located substantially at a center of first passenger seat beam rotator 240*a* and second passenger seat beam rotator 240*b* is similarly pivotally connected to second lift arm 220*b* at a pivot point substantially located at a center of second passenger seat beam rotator 240*b*. The pivot can be part of first lift arm 220*a* or second lift arm 220*b* and fit into a corresponding void in first lift arm 220*a* or second lift arm 220*b*, respectively, or can be a part of first lift arm 220*a* and second lift arm 220*b* and fit into a corresponding void in first passenger seat beam rotator 240*a* and second passenger seat beam rotator 240*b*, respectively.

In this embodiment, passenger seat beam rotator actuator 241*a*, 241*b* typically comprises one or more rotary motors which move passenger seat assembly 260 via passenger seat beam rotators 240*a*, 240*b* to directly impart pitch to seat beams 260*a*, 260*b* relative to pitch rotators 240*a*, 240*b* so that pitching the upper row, e.g. 260*a*, causes the front row, e.g. 260*b*, to synchronously pitch. Where rotary motors are used, pitch rotators 240*a*, 240*b* may further comprise a chain or sprocket set 242*a*, 242*b*. In certain contemplated embodiments, each row 260*a*, 260*b* may be pitched by its own pair of motors, obviating the mechanical interconnection.

System controller 201, 202 is operative to control and coordinate movement of first lift arm 220*a* and second lift arm 220*b* in their respective X-Y planes while simultaneously effecting a change to a pitch angle of passenger seat assembly 260.

In contemplated versions of this embodiment, passenger seat assembly 260 typically comprises one or more seat beams 260*a* operatively connected to first passenger seat beam rotator 240*a* at a first end of first passenger seat beam rotator 240*a* and to second passenger seat beam rotator 240*b* at a corresponding first end of second passenger seat beam rotator 240*b* substantially parallel to the seat axis and one or more seat beams 260*b* operatively connected to first passenger seat beam rotator 240*a* at a second end of first passenger seat beam rotator 240*a* distally from the first end and to second passenger seat beam rotator 240*b* at a corresponding second end of second passenger seat beam rotator 240*b* substantially parallel to the first seat beam 260*a*. In addition, passenger seat assembly 260 further typically comprises one or more passenger seats 163 (FIG. 2) connected to each seat beam 260*a*, 260*b*. Further, passenger seat assembly 260 may further comprise canopy (not shown in the figures) and/or shield (not shown in the figures).

In some configurations of this embodiment, one or more safety encoders 280 may be present and operatively in communication with system controller 201, 202 where safety encoder 280 is operative to provide a measurement of an offset of first passenger seat beam rotator 240*a* or second passenger seat beam rotator 240*a* from the seat axis. Typically, one or more safety encoders 280 are disposed at predetermined locations, typically at or near joints of seat beam rotator 240*a*, 240*b*.

Further, in this embodiment one or more sensors 281, 282 may be present and operatively in communication with system controller 201, 202 where sensors 281, 282 are operative to provide a measurement of a predetermined physical characteristic of first lift arm 220*a* or second lift arm 220*b* such as pressure transducer 281, linear transducer 282, or the like, or a combination thereof. Typically, sensors 281, 282 are used to monitor and report lift arm positions to help ensure that they are in sync with each other.

Where motors 241*a*, 242*b* and/or 221*a*, 221*b* are used, each may be safety encoders 280 and/or sensors 281, 282 may be used to help monitor the rotation output of an associated motor 241*a*, 242*b* and/or 221*a*, 221*b*.

In contemplated versions of this embodiment, one or more brakes (not shown in the figures) may be present and operatively connected to first lift arm 220*a* or second lift arm 220*b*, where the brake is operative to impede motion of first lift arm 220*a* and/or second lift arm 220*b*. Brakes may impart braking action to a motor, a shaft rotated or translated by a motor, or a disk or other feature designed to receive such action. In other embodiments, braking may more-or-less passive and be accomplished by the normal state of electrical motors with power removed, or the physical characteristics of hydraulic properties when under pressure.

In contemplated versions of this embodiment, one or more motion dampers 221*a*, 221*b* may be present and operatively connected to seat support base 210*a*, 210*b*, 210*c*, 210*d*, first lift arm 220*a*, and/or second lift arm 220*b*. Motion dampers 221*c*, 221*d* typically comprise first motion damper 221*c* operatively connected to first lift arm 220*a* and second motion damper 221*d* operatively connected to second lift arm 220*b*.

In contemplated versions of this embodiment, seat support base 210*a*, 201*b*, 210*c*, 210*d* may be a singular piece or multiple pieces. By way of example and not limitation, seat support base 210*a*, 201*b*, 210*c*,210*d* may comprise first seat support base 210*a*, 210*b* connected to first lift arm 220*a* and second seat support base 210*c*,210*d* connected to second lift arm 220*b*. If motion dampers 221*c*, 221*d* are present, seat support base 210*a*, 201*b*, 210*c*, 210*d* may further comprise first seat support base 210*a* operatively connected to first motion damper 221*c*; second seat support base 210*b* connected to first lift arm 220*a*; third seat support base 210*c* connected to second motion damper 221*d*; and fourth seat support base 210*d* connected to second lift arm 220*b*.

Figure 2:
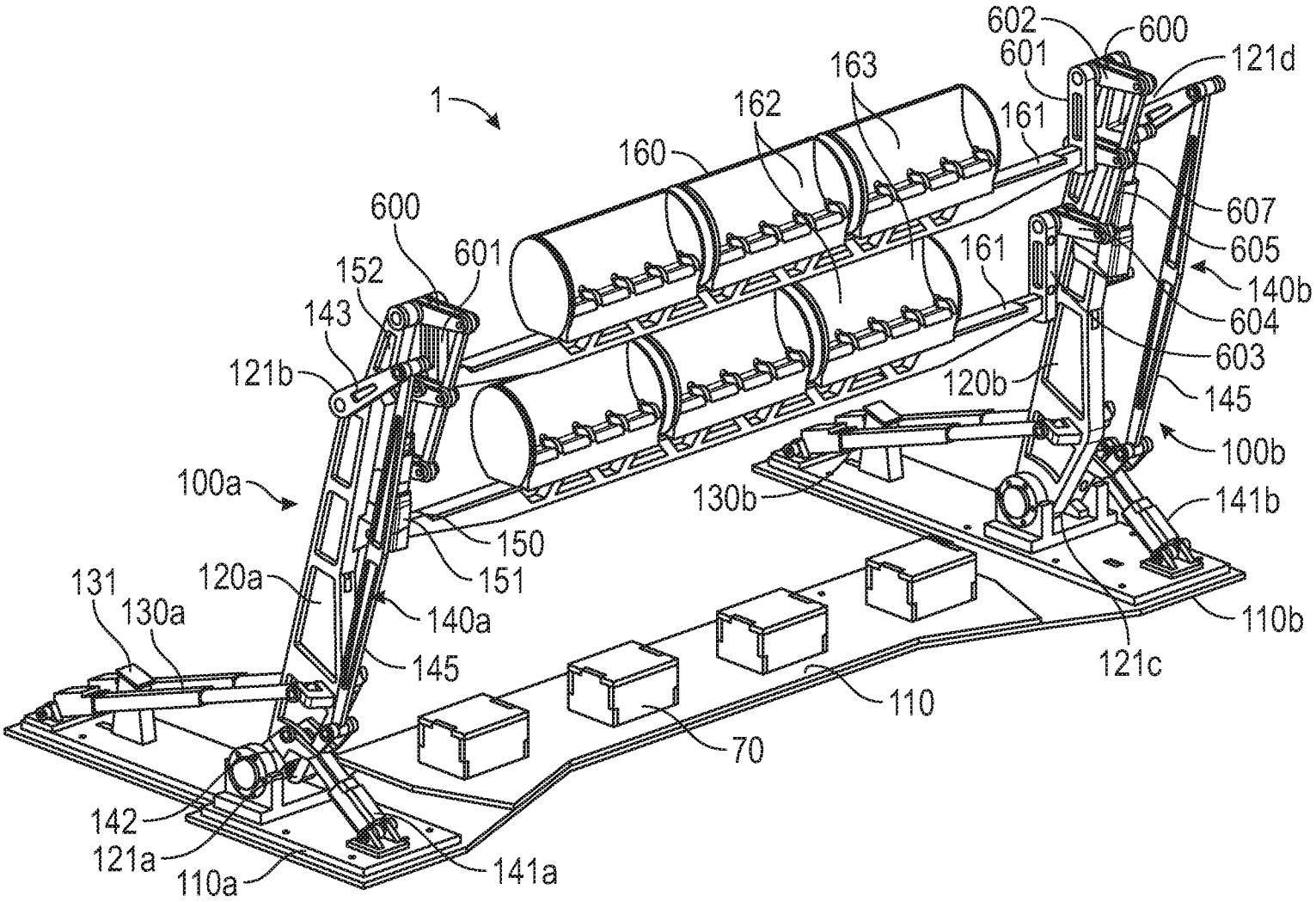
FIG. 2 is a view in partial perspective of a second embodiment of the invention.

Referring now to FIG. 2, in a further embodiment, seat support base 110 comprises first edge 110*a* and second edge 110*b* disposed opposite first edge 110*a*. In this embodiment, first seat support 200*a* (FIG. 1) comprises first lift arm 120*a* pivotally connected to first edge 110*a* at first lift arm seat support base end 121*a* and second seat support 200*b* comprises second lift arm 120*b* pivotally connected to second edge 110*b* at second lift arm seat support base end 121*c*. In this embodiment, first lift arm actuator 130*a* is operatively connected to seat support base 110, such as at first edge 110*a*, and operative to effect movement of first lift arm 120*a* in a first X-Y plane defined by seat support base 110 and first lift arm 120*a*. Second seat support 200*b* comprises second lift arm actuator 130*b* operatively connected to seat support base 110 and operative to cooperatively effect substantially identical movement of second lift arm 120*b* in a second X-Y plane defined by seat support base 110 and second lift arm 120*b* to the movement of first lift arm 120*a* in the first X-Y plane, the second X-Y plane substantially parallel to the first X-Y plane; passenger seat assembly 160 movably disposed intermediate first lift arm 120*a* at attachment arm end 121*b* disposed opposite first lift arm seat support base end 121*a* and to second lift arm 120*b* at attachment arm end 121*d* disposed opposite second lift arm seat support base end 121*c*, the passenger seat assembly 160 defining a passenger seat row axis disposed longitudinally between first lift arm 120*a* and second lift arm 120*b*; and first passenger seat beam rotator 140*a* and second passenger seat rotator 140*b* which are operative to change a pitch angle of passenger seat assembly 160 about the passenger seat row axis. In this embodiment, first edge 110*a* may extend at an angle from seat support base 110 and second edge 110*b* may also extend at an angle from seat support base 110.

In this embodiment, movement of first lift arm 120*a* is limited to movement within the first X-Y plane and movement of second lift arm 120*b* is limited to movement within the second X-Y plane.

In this embodiment, arm actuator 130 comprises first lift arm actuator 130*a* which is pivotally connected to first lift arm 120*a* and further pivotally connected to first edge 110*a* and second lift arm actuator 130*b* which is pivotally connected to second lift arm 120*b* and further pivotally connected to second edge 110*b*. In this embodiment, first lift arm actuator 130*a* typically comprises a plurality of arm actuators, each pivotally connected to first edge 110*a* and to first lift arm 120*a*, and second lift arm actuator 130*a* further comprises a plurality of arm actuators, each pivotally connected to second seat support base edge 110*b* and to second lift arm 120*b*.

In this embodiment, first passenger seat beam rotator actuator 140*a* is pivotally connected to seat support base 110 proximate the first lift arm seat support base end 121*a* and further comprises pitch link 145, lower crank 142 pivotally connected to first passenger seat row rotator 140*a* at a first lower crank end and pivotally connected to pitch link 145 at second lower crank end, and upper crank 143 pivotally connected to attachment arm end 121*b* at a first upper crank end and pivotally connected to pitch link 145 at a second upper crank end. Further, second passenger seat beam rotator actuator 140*b* is generally identical to first passenger seat beam rotator actuator 140*a* and pivotally connected to the seat support base 110 proximate second lift arm seat support base end 121*b*. First passenger seat pitch actuator 140*a* and the plurality of arm actuators 130, if present, are operative to cooperatively effect changes to the pitch angle of passenger seat assembly 160 an maintain the same pitch angle of passenger seat assembly 160 at first lift arm 120*a* relative to seat support base 110 with respect to the pitch angle of passenger seat assembly 160 at second lift arm 120*b* relative to seat support base 110.

Moreover, in this embodiment passenger seat row rotator 150 further comprises one or more passenger seat row rotator pitch cranks 152 pivotally connected to at least one of first lift arm 120*a* and second lift arm 120*b* proximate attachment arm ends 121*b*, 121*d* of its respective arm and to passenger seat row rotator actuator 151 pivotally connected to at least one of first lift arm 120*a* and second lift arm 120*b* at a first end of passenger seat row rotator actuator 151 and pivotally connected to passenger seat row rotator pitch crank 152 at a second end of passenger seat row rotator actuator 151.

In this embodiment, passenger seat assembly 160 is similar to that which was described above and further comprises one or more seat beams 161 and at least one passenger seat 162 connected to seat beam 161. In this embodiment, however, passenger seat assembly 160 further comprises first seat beam hanger 600 pivotally connected to first lift arm 120*a* proximate first lift arm attachment end 121*b* at an upper seat beam hanger end 601 and to an end of seat beam 161 closest to first lift arm 120*a* as well as second seat beam hanger 600 pivotally connected to second lift arm 120*b* proximate second lift arm attachment end 121*d* at an upper seat beam hanger end 601 and to an end of seat beam 161 closest to second lift arm 120*b*. Where passenger seat assembly 160 comprises two seat beams 161, each seat beam hanger 600 of the seat beam hangers 600 typically further comprises upper seat beam hanger crank 602 pivotally connected to arm attachment end 121*b*,121*d* of its respective arm; lower seat beam hanger crank 604; and seat beam hanger link 605 pivotally connected at a first seat beam hanger link end to the upper seat beam hanger crank and pivotally connected at a second seat beam hanger link end to the lower seat beam hanger crank, where the upper seat beam hanger crank and the lower seat beam hanger crank are operative to maintain substantially identical rotation of each seat beam 161 with respect to each other about their respective passenger seat row axis.

In this embodiment, theater system 1 may further comprise first lift arm travel limiter 131 disposed on first edge 110*a* proximate where arm actuator 130 is operatively connected to first edge 141, where first lift arm travel limiter 131 is configured to stop movement of first lift arm 120*a* in the first X-Y plane. A similar lift arm travel limiter 131 may be present and disposed on second edge 110*b* for limiting movement of second lift arm 120*b*.

Figure 3:
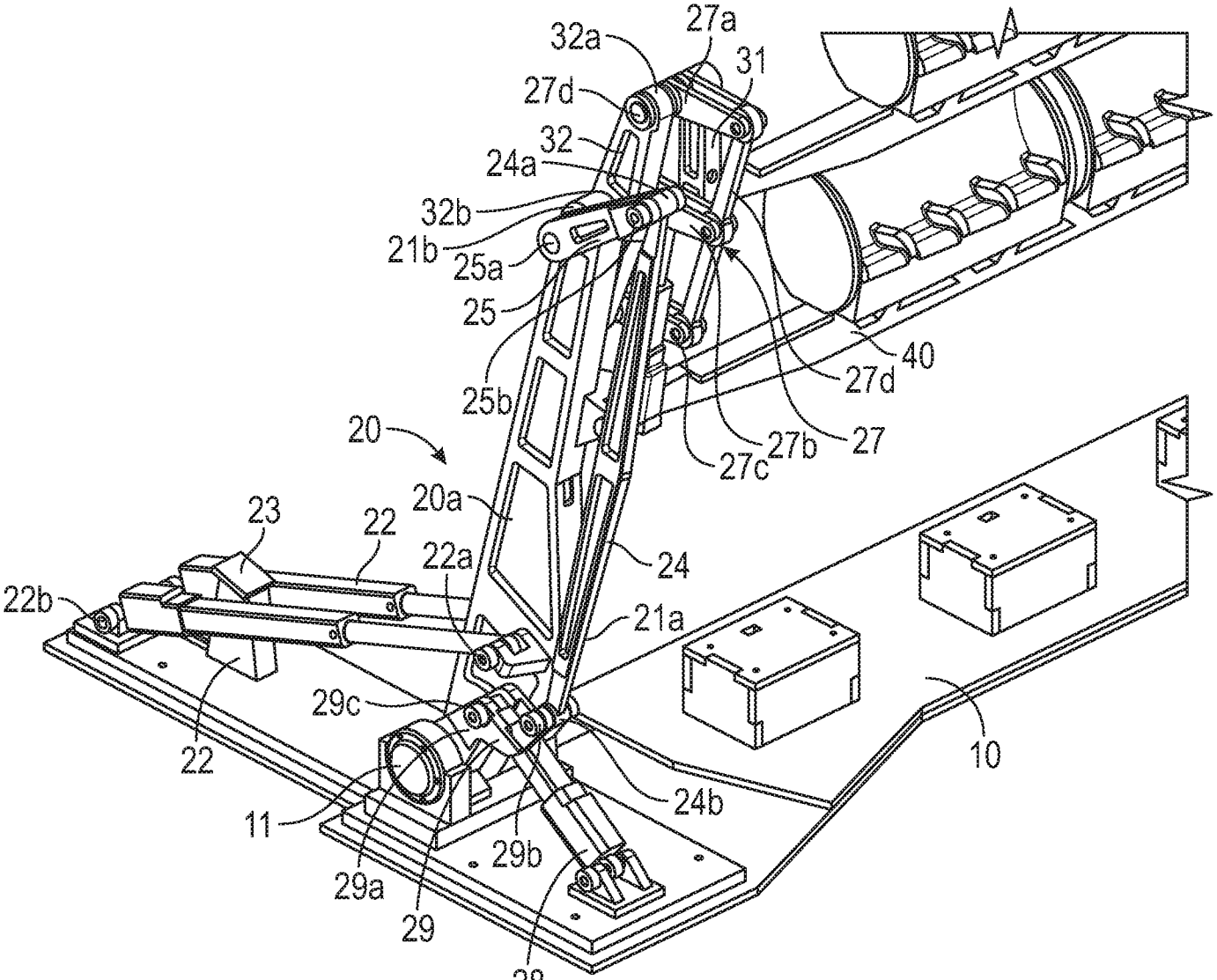
FIG. 3 is a closer view in partial perspective of the second embodiment of the invention.
Figure 4:
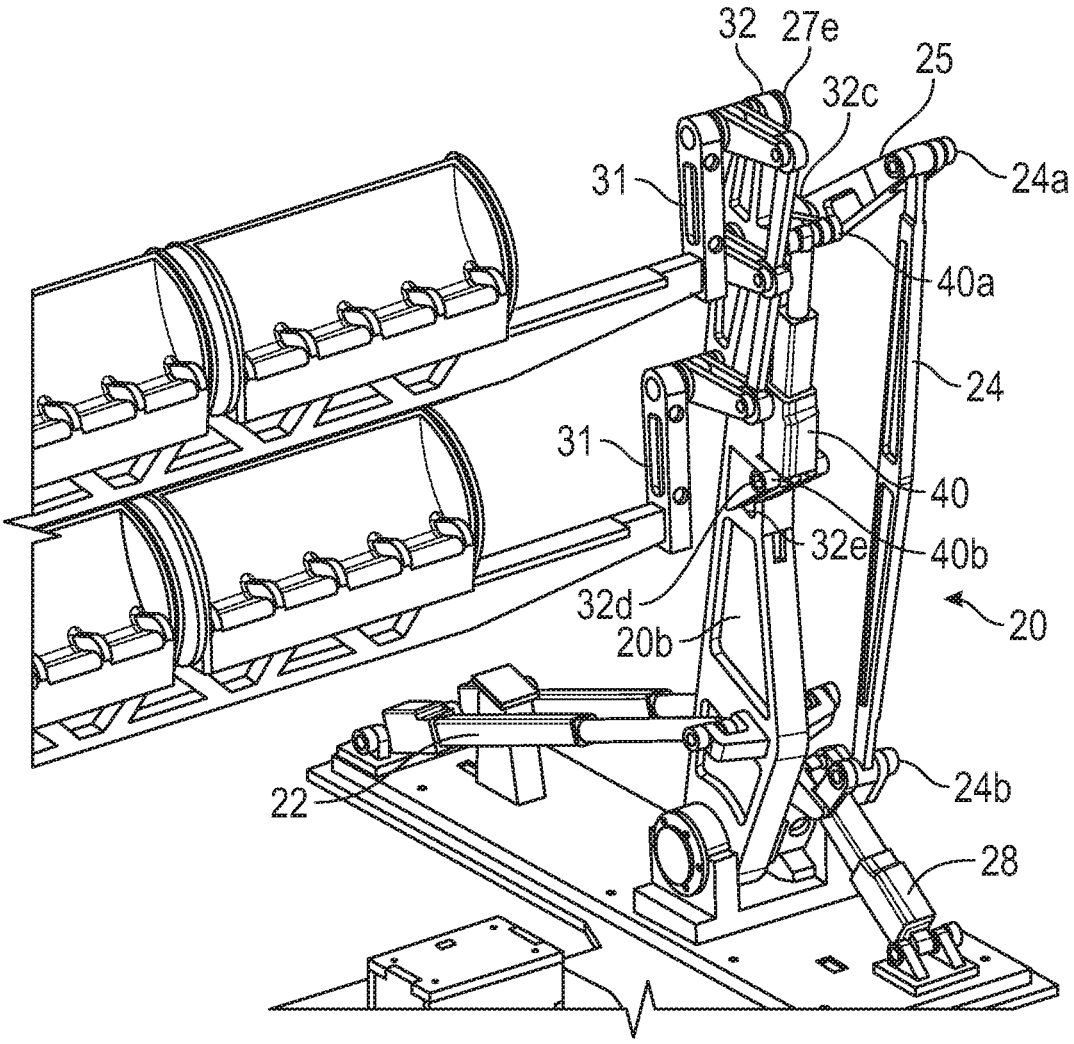
FIG. 4 is a closer view in partial perspective of the second embodiment of the invention.

Referring additionally to FIG. 3 and FIG. 4, in a similar embodiment each of first passenger seat beam rotator 140*a* (FIG. 2) and second passenger seat rotator 140*b* (FIG. 2) may comprise rotator arm 32 and rotator arm limiter 32*e* configured limit angular travel of rotator arm 32 about its rotator arm actuator joint 32*c* in a plane defined by lift arm 120*a*, 120*b* such as their respective X-Y planes. Typically, rotator arm limiter 32*e* comprises a channel or feature of the joint, such that over-rotation is mechanically prevented by a surface on the rotator arm coming into contact with an opposing surface on lift arm 140, near the pivotal joint by which they are connected. Alternatively, the limiter comprises a feature within the actuator, such as a mechanical hard stop at ends of travel, or a limit switch or sensor which detects a limit in motion. There is a plan to include physical hard tops as a redundant safety measure. The first method of control will be through programming limits. A limit switch might also be used to trigger the end of travel.

In this further embodiment, referring still to FIGS. 2-4, theater system 1 comprises one or more seat support base platforms 10; one or more seat actuators 1; first side lift 20; second side lift 20 substantially identical to first side lift 20 but arranged in a mirror orientation with respect to the first side life on seat support base platform 10; first seat row beam hanger 31 pivotally connected to the rotator pitch crank joint 32*a* at a beam hanger joint 27*e*; second seat row beam hanger 31 disposed proximate the upper end of the second side lift's lift arm in a mirror orientation with respect to the first seat row beam hanger; seat row beam 30 disposed intermediate the first seat row beam hanger and the second seat beam hanger and rigidly connected to the first seat row beam hanger and the second seat beam hanger; one or more passenger seats 162 operatively connected to the seat row beam 30; and system controller operatively in communication with and configured to control a predetermined set of functions of the rotate actuators 40, pitch actuators 28, and lift actuators 22.

In this embodiment, seat support base 10 may comprise first seat support base 10*a* connected to the first lift arm 20*a* at the first lift arm seat support base end 21*a* and second seat support base 10*b* connected to the second lift arm 20*b* at the second lift arm seat support base end 21*c*.

First side lift 20, in this embodiment, comprises one or more first lift arms 20*a* disposed at a first side of seat support base platform 10 where first lift arm 20*a* comprises first end 21*a* pivotally connected to seat support base platform 10 and pitch link end 21*b* distally located from first end 21*a*; one or more rotator arms 32, pivotally connected to lift arm 20 proximate pitch link end 21*b* at rotator arm middle joint 32*b*, rotator arm 32 further comprising upper beam arm joint 32*a*, lower rotator arm joint 32*d*, and rotator arm actuator joint 32*c* disposed intermediate upper rotator arm joint 32*a* and lower rotator arm joint 32*d*; one or more rotate actuators 40 pivotally connected to rotator arm 32 at upper rotator arm joint 32*a* and lower rotator arm joint 32*d*; one or more upper pitch links 27 comprising upper pitch link crank 27*a* pivotally connected to upper rotator arm joint 32*a*, lower pitch link crank 27*c* pivotally connected to lower rotator arm joint 32*d*, and pitch link 27*d* pivotally disposed intermediate upper pitch link crank 27*a* and lower pitch link crank 27*c*; lower pitch link 29 pivotally connected to first end 21*a* of lift arm 20*a*, lower pitch joint comprising arm joint 29*c*, lower pitch link joint 29*b* disposed distally from arm joint 29*c*, and actuator joint 29*a* disposed intermediate arm joint 29*c* and lower pitch link joint 29*b*; pitch crank 25 comprising first pitch crank end 25*a* pivotally connected to pitch link end 21*b* and second pitch crank end 25*b*; pitch link 24 comprising upper pitch link joint 24*a* pivotally connected to second pitch crank end 25*b* and lower pitch link joint 24*b* pivotally connected to lower pitch link joint 29*b*; pitch actuator 28 pivotally connected to seat support base platform 10 and pivotally connected to actuator joint 29*a*; and lift actuator 22 pivotally connected to seat support base platform 10 distally from pitch actuator 28 and pivotally connected to lift arm 20 at lift actuator joint 22*a* disposed proximate first end 21*a* of lift arm 20*a* intermediate seat support base platform 10 and rotator pitch crank 29.

Second side lift 20 is typically substantially identical to first side lift 20 and therefore its description and callouts are the same or highly similar.

In this embodiment, rotator arm 32 may further comprise rotator arm limiter 32*e* configured limit angular travel of rotator arm 32 about its rotator arm actuator joint 32*c* in a plane defined by its associated lift arm 20. Additionally, passenger seat row rotator 50 is operative to effect a change in passenger seat row rotation independently of movement of first lift arm 20*a* and second lift arm 20*b*.

In this embodiment, each of first seat row beam hanger 31 and second seat row beam hanger 31 may further comprise a link clevis.

In this embodiment, referring additionally to FIGS. 7-9 and FIGS. 11-12, rotate actuators 40, pitch actuators 28, and lift actuators 22 are cooperatively operative to control an angular relationship between lift arm 20 and its associated rotator arm 32 by adjusting an angular relationship between the two between a first lift arm lowered position to a second lift arm raised show position. Further, rotate actuators 40, pitch actuators 28, and lift actuators 22 comprise linear actuators configured to motivate the lift arm 20 between a lowered position and a raised position.

In certain configurations of this embodiment, seat row beam hanger 31 comprises a plurality of seat row beam hangers 31 and the seat row beam 30 comprises a plurality of seat row beams 30 linearly displaced from each other intermediate first end 21*a* and second end 21*b* of lift arms 20, each seat row beam 30 of the plurality of seat row beams 30 operatively connected to a corresponding set of seat row beam hangers 31 of the plurality of seat row beam hangers 31, each seat row beam hanger 31 of the plurality of seat row beam hangers 31 linked to at least one other seat row beam hanger 31 of the plurality of seat row beam hangers 31 and configured to create synchronous pitch between the plurality of seat row beams 30.

In any of these embodiments, one or more masses may be associated with each lift arm and disposed on a side of the lift arm's seat support base bearing axis as a counterbalance.

In any of these embodiments, mechanical assistance may be incorporated with lift arm actuators 22, 221 so as to reduce energy consumption, e.g. one or more spring assemblies, pneumatic cylinders, or hydraulic cylinders (which communicate with one or more nitrogen-filled vessels) disposed proximate to, and configured to act in association with and for the alleviation of load upon, the lift arm actuators 22, 221.

Figure 5:
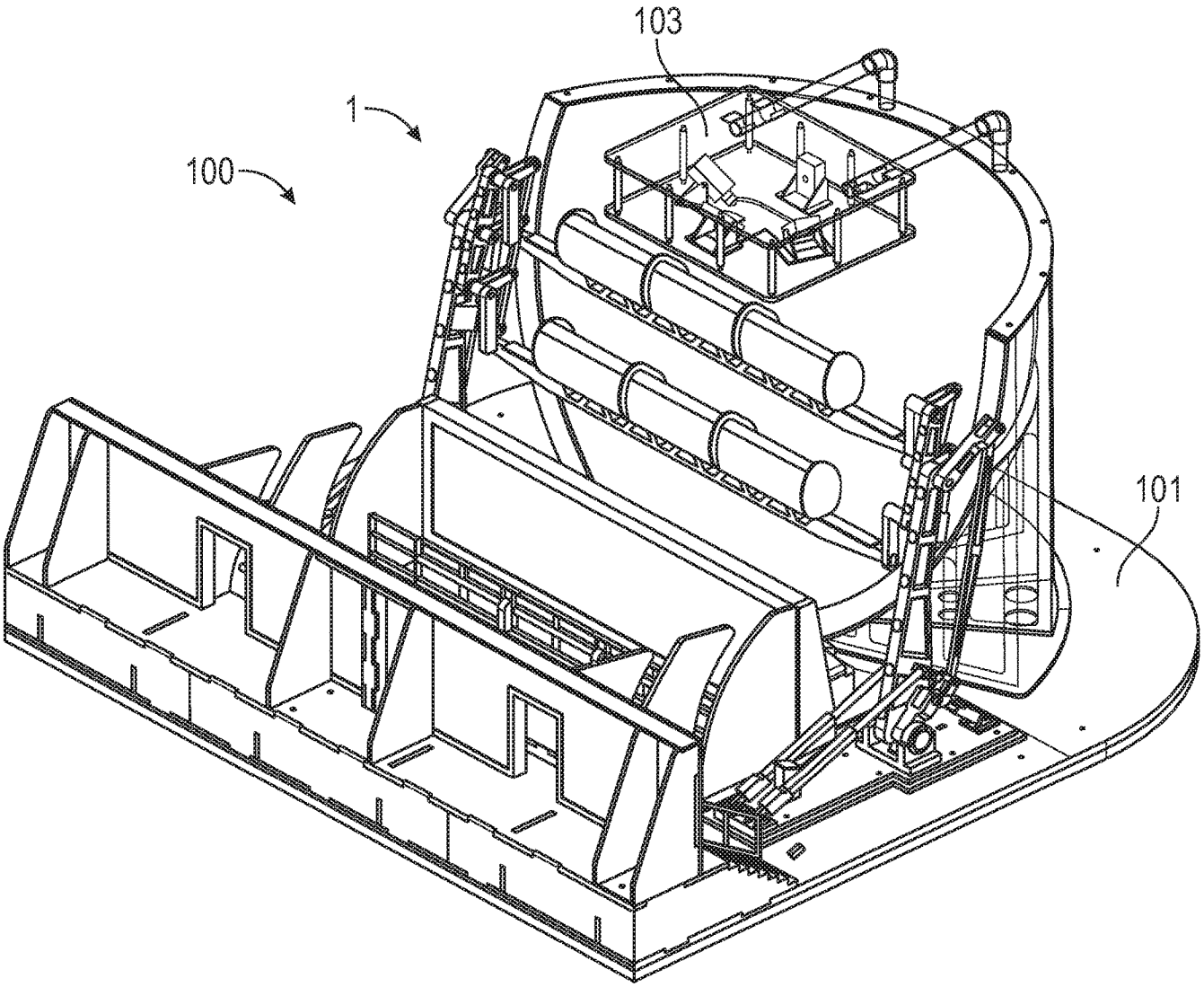
FIG. 5 is a view in partial perspective of a theater using an embodiment of the invention.
Figure 6:
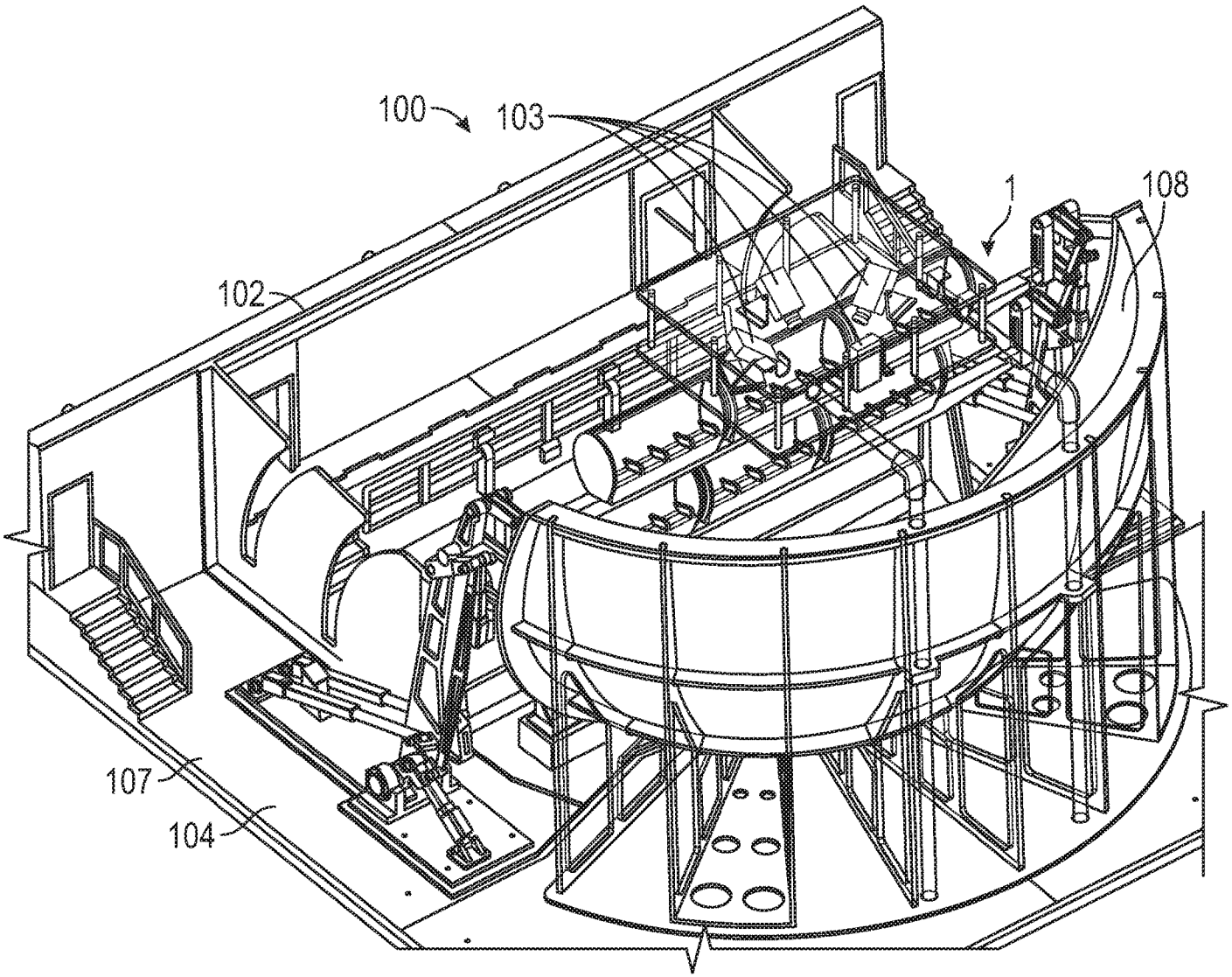
FIG. 6 is a view in partial perspective of a theater using an embodiment of the invention.
Figure 7:
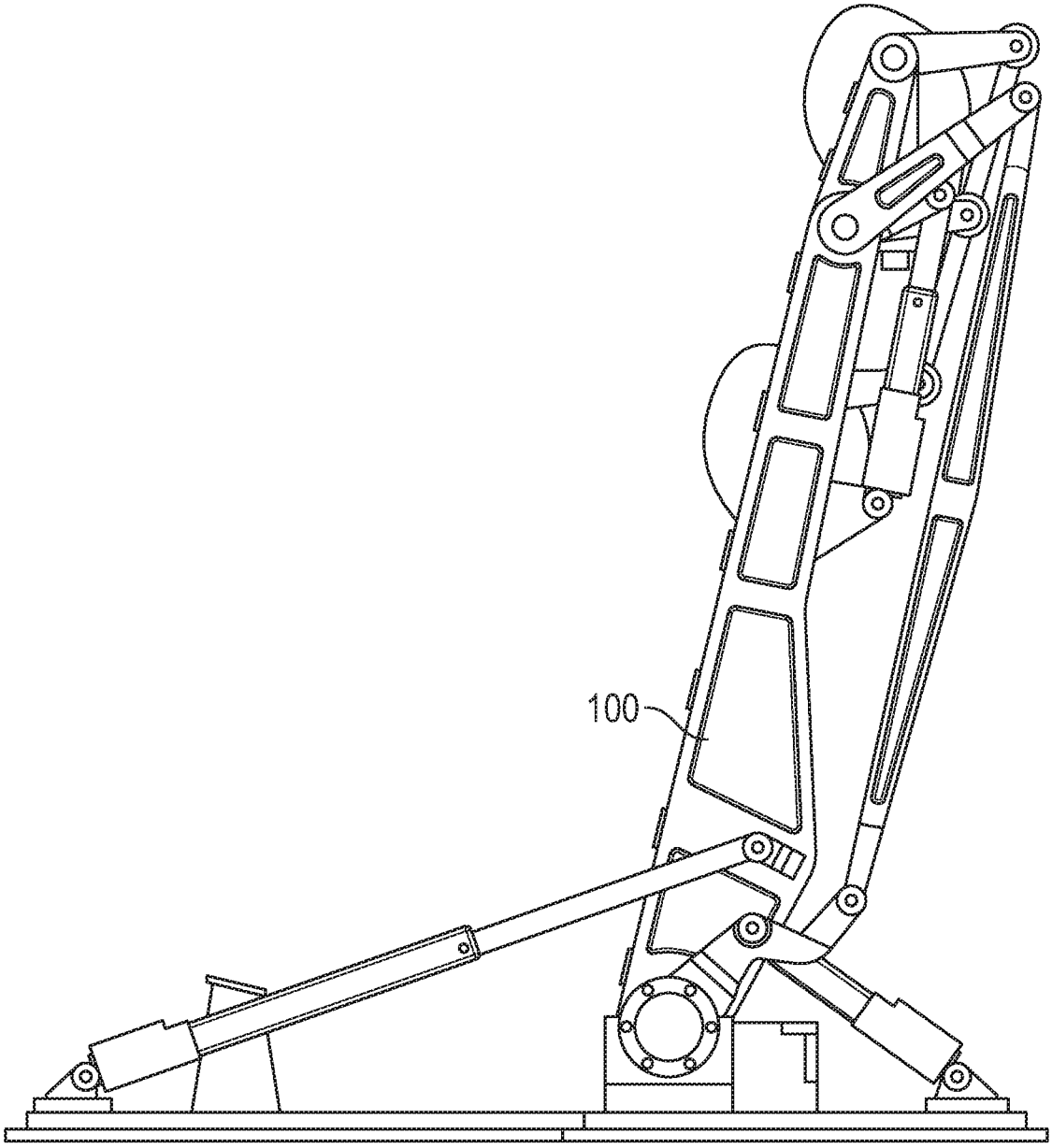
FIG. 7 is a side view in partial perspective of the second embodiment of the invention.
Figure 8:
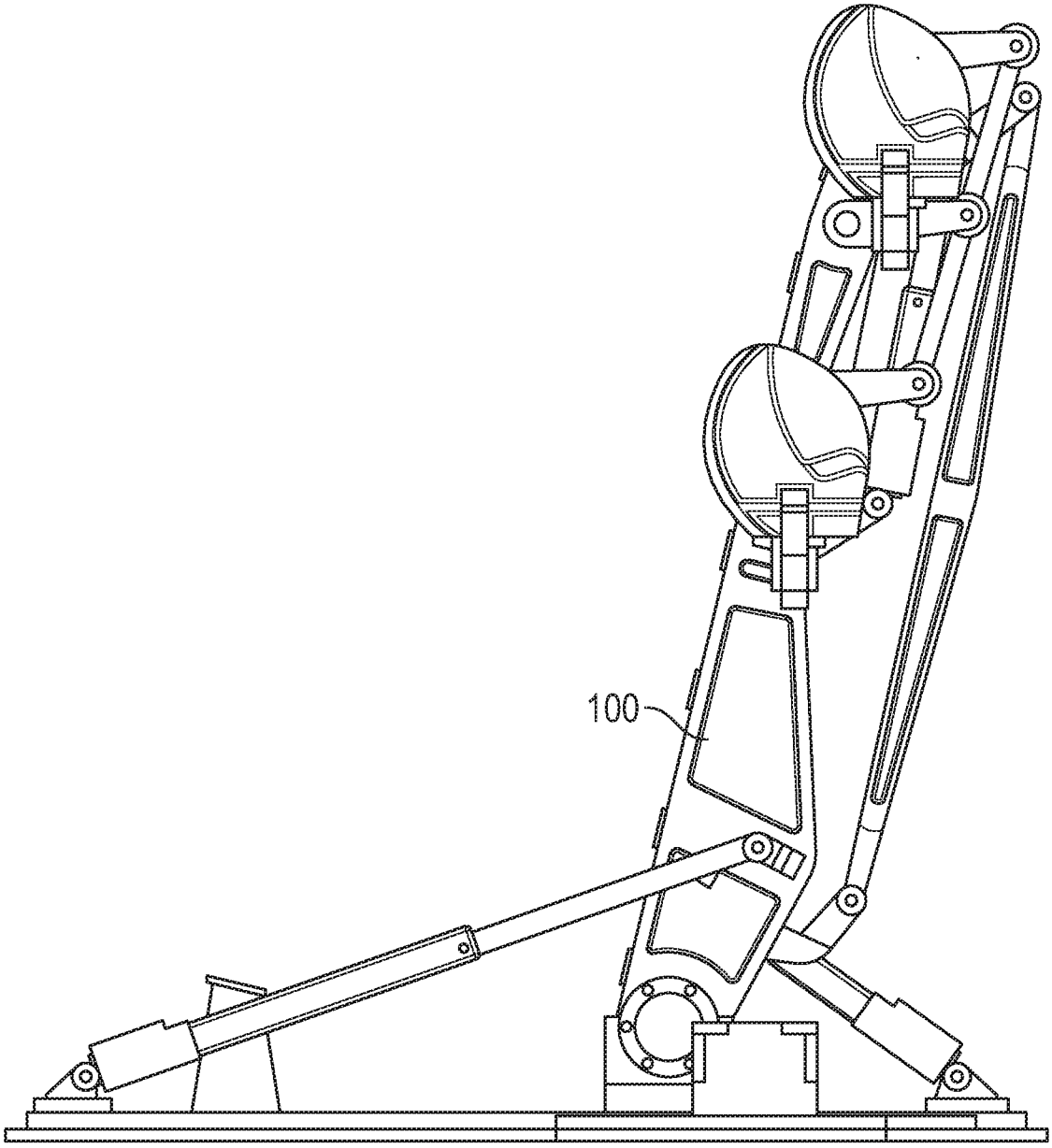
FIG. 8 is a side view in partial perspective of the second embodiment of the invention.
Figure 9:
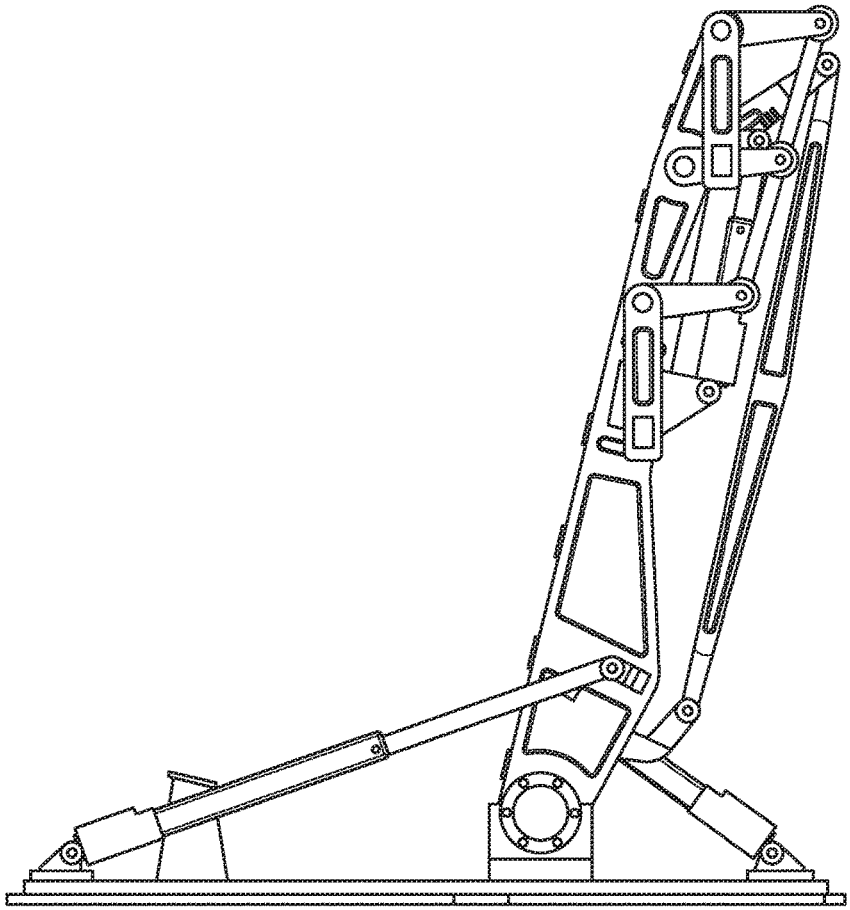
FIG. 9 is a side view in partial perspective of the second embodiment of the invention without seats.
Figure 10:
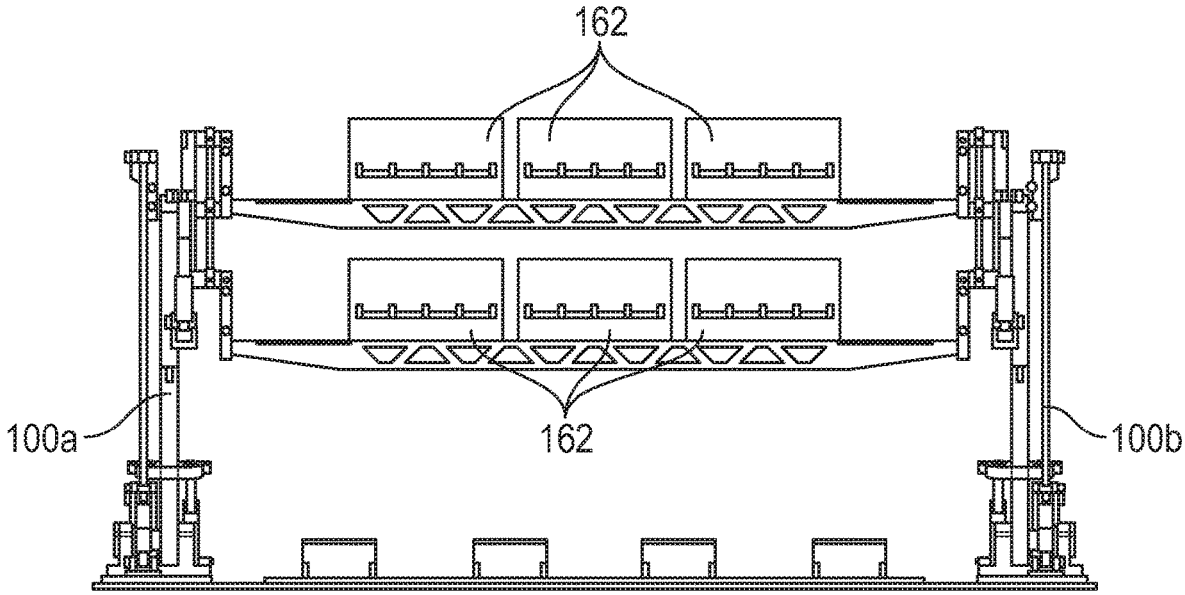
FIG. 10 is a front view in partial perspective of the second embodiment of the invention.
Figure 11:
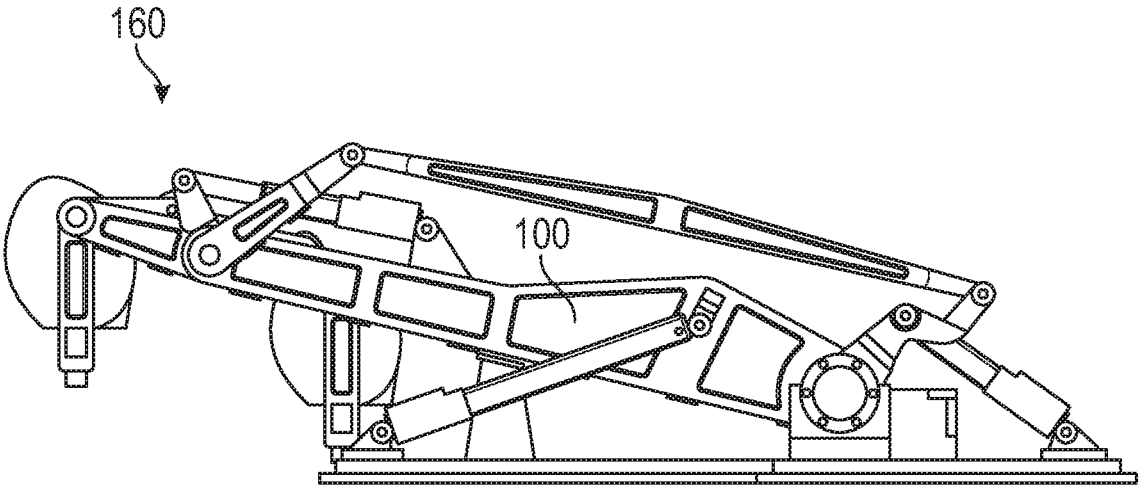
FIG. 11 is a side view in partial perspective of the second embodiment of the invention in a lowered position.
Figure 12:
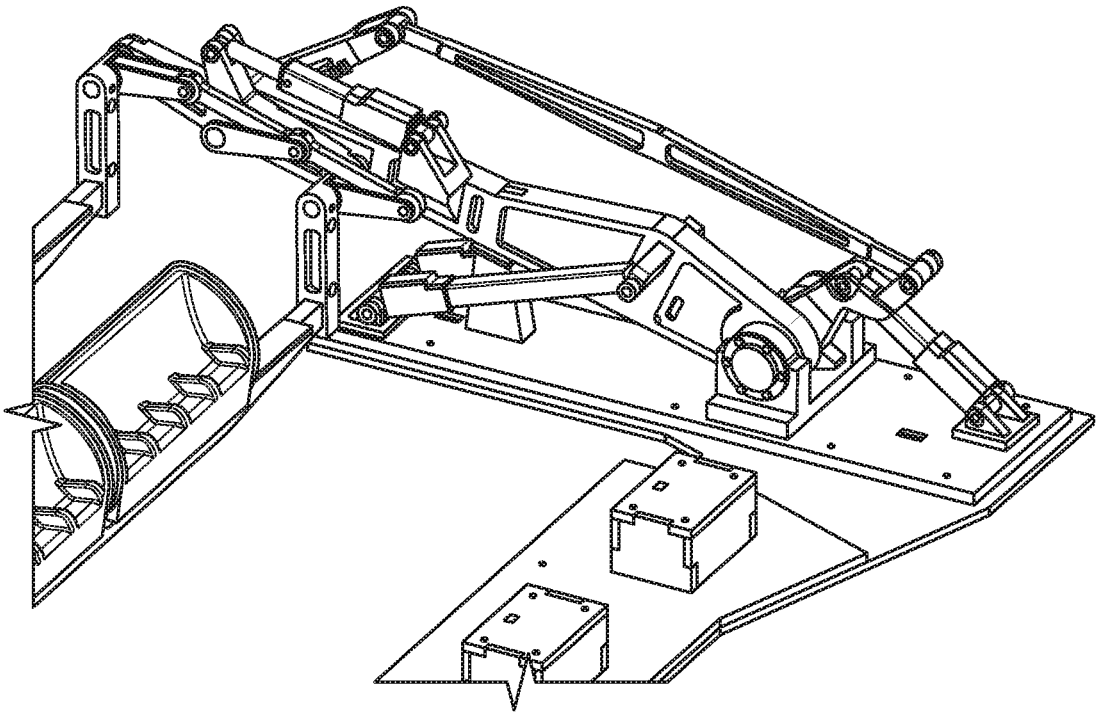
FIG. 12 is a close-up side view in partial perspective of the second embodiment of the invention in a lowered position.

Referring now to FIGS. 5 and 6, immersive theater system 100 comprises theater housing 102; theater seating assembly 1, as described in any of the embodiments above, disposed at least partially within theater housing 102, and one or more audiovisual projectors 103 operatively in communication with system controller 70, 201, 202 (FIG. 1). Typically, seat row beams 161, 261 (FIG. 1, FIG. 2) extend outward and through aisle area 107 on each side of theater seating assembly 1 into left and right equipment spaces 104 where they then attach to their respective rotators 140, 240 (FIG. 1, FIG. 2). As used herein, an audiovisual projector may be a video projector, a combined video-sound system with speakers, or the like, or a combination thereof.

Figure 13:
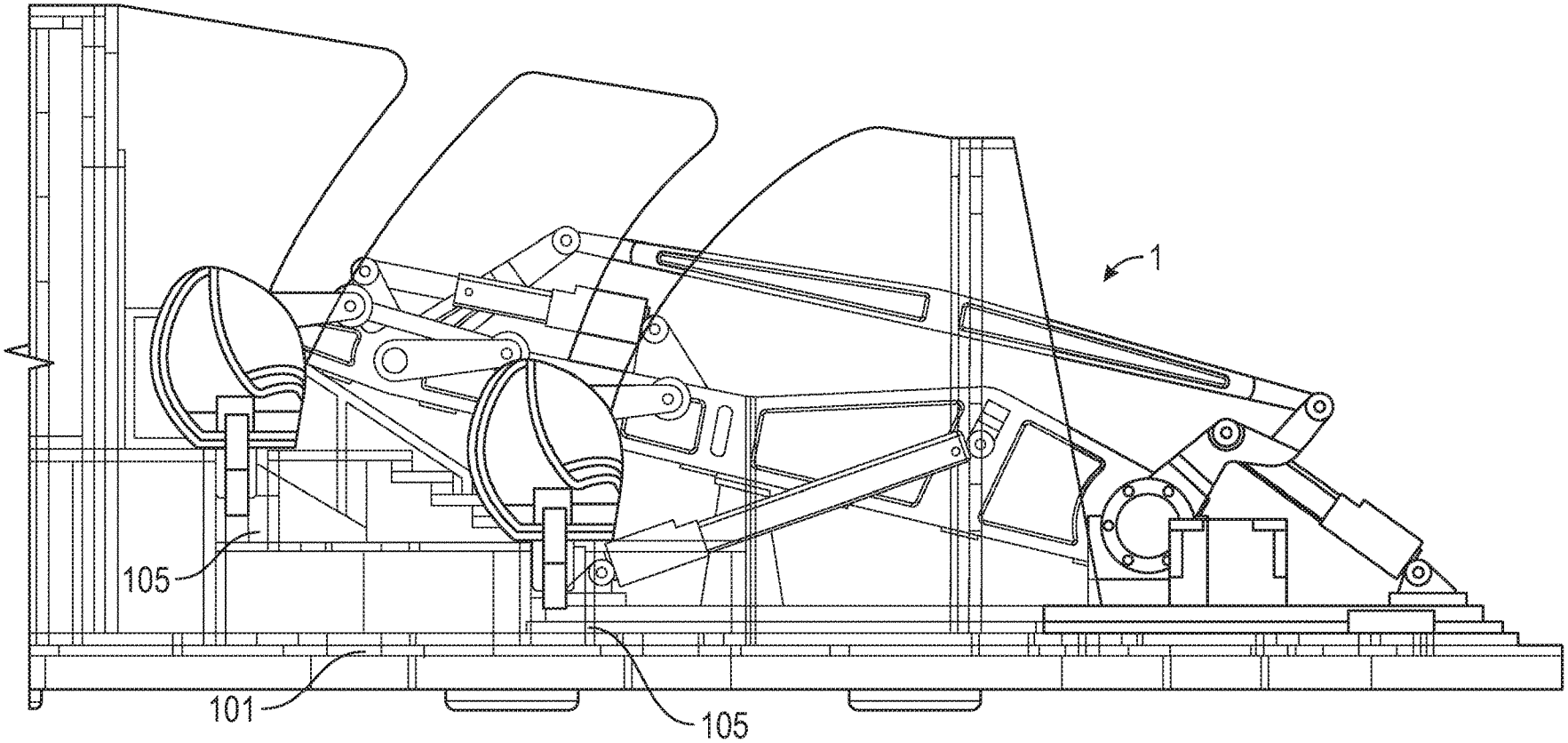
FIG. 13 is a side view in partial perspective of the second embodiment of the invention in a lowered position illustrating a floor channel.

Referring additionally to FIG. 13, in certain configurations of this embodiment, immersive theater system 100 comprises floor 101 where a portion of floor 101 may be configured to be elevated with respect to one or more seat row beams 161, 261 (FIG. 1, FIG. 2) such as to promote shielding of dropped objects from an upper passenger seat to a lower passenger seat. As also noted above, a canopy (not shown in the figures) may be present and fixed over each passenger seat 162 which moves with its associated passenger seat 162. Additionally, floor 101 may comprise nesting slot or channel 105 which can accommodate all or a portion of seat row beams 161, 261 (FIG. 1, FIG. 2).

In the operation of exemplary methods, as will be understood by one of ordinary skill in theater seating art, reference below to "an" embodiment, unless noted otherwise, is applicable, but not limited to, to other embodiments discussed above.

Referring back to FIG. 1 and FIGS. 5-6, a theater experience, typically an immersive theater experience, may be accomplished using theater system 1 as described above by positioning first seat support 200*a* and second seat support 200*b* and rotating passenger seat assembly 260 to a passenger boarding position sufficient to allow a passenger to sit in passenger seat assembly 260 (FIG. 13). System controller 70, 201, 202 substantially synchronously controls first seat support 200*a* and second seat support 200*b* and their associated passenger seat beam rotators 240*a*, 240*a* via their associated seat beam rotator actuator 241*a*, 241*b* to effect a motion between each lift arm 220*a*, 220*b* and its associated actuator 221*a*, 221*b* such as by adjusting the angular relationship between a lift arm lowered position (FIG. 11, 13) to a lift arm raised position (FIGS. 7-10) at a first predetermined set of times. Rather than pivoting passenger seat assembly 260 with a rotating floor, positions of passenger seat assembly 260 are thus altered while a raising and/or lowering function is taking place. Effecting the pitch change typically occurs at a time from the second predetermined set of times when first lift arm 220*a* and second lift arm 220*b* are being raised or lowered.

Typically, arm actuators 221*a*, 221*b* are as described above and operative to effect movement in first lift arm 220*a* in a first X-Y plane defined by seat support base 210*a*, 210*b* and first lift arm 220*a* and cooperatively effect substantially identical movement of second lift arm 220*b* in a second X-Y plane defined by seat support base 210*c*,210*d* and second lift arm 220*b* where the second X-Y plane is substantially parallel to the first X-Y plane. Movement effected by passenger seat beam rotators 240*a*, 240*b* is operative to change a pitch angle of passenger seat 260 about the passenger seat row axis. In most embodiments, system controller 70, 201, 202 is operatively in communication with arm actuators 221*a*, 221*b* and passenger seat beam rotators 240*a*, 240*b* and coordinates movement of first lift arm 220*a* and second lift arm 220*b* in their respective X-Y planes while simultaneously effecting a change to the pitch angle.

In embodiments wherein floor 101 (FIG. 13) further comprises nesting slot or channel 105 (FIG. 13) configured to accept seat row beam 260*a*, 260*b* therein, seat row beam 260*a*, 260*b* closest to nesting slot 105 may be nested into nesting slot 105 in a first position, thereby hiding that seat row beam 260*a*, 260*b* from audience view while in this lowered load/unload first position.

Referring again to FIG. 6, immersive theater system 100 typically further comprises one or more audiovisual projectors 103 as described above and movement of first seat support 200*a* and second seat support 200*b*, as well as rotation of passenger seat assembly 260, is coordinated with audiovisual projector 103. Thus, the first predetermined set of times and the second predetermined set of times are typically programmed to coincide with a human perceptive presentation such as from or in coordination with projection from audiovisual projector 103.

At times, a surge front to back translation may be provided or imparted while seat supports 200*a*, 220*b* are in a raised show position by combining the motions of lift and rotate. Further, the pitch function may be used to maintain passenger seat assembly 260 at a predetermined position with positive and negative pitch available in a raised or show position.

If passenger seat assembly 260 comprises a plurality of seat beams, e.g. first seat beam 260*a* and second seat beam 260*b* as described above, a rotate function may be controlled using system controller 70, 201, 202 to bring one seat beam of seat row beams 260*a*, 260*b* and its associated passenger seats 163 (FIG. 2) up and over a second set of seat row beams 260*a*, 260*b* and its associated passenger seats 163, thereby allowing control over mutual row position during lift and during a show. Additionally, as illustrated in FIGS. 7-12, the rotate function may be used to allow seat row beams 260*a*, 206*b* and their associated passenger seats rows 163 to flatten out, such as from front to back, in order to "hop" over a lower theater screen or wall during lift and achieve a predetermined final vertical relationship once past that hurdle. Also, a second function may be performed, e.g. via command from system controller 70, 201, 202, to alter mutual positions of seat row beams 260*a* and their associated passenger seats 163 relative to one another while a lift function is taking place.

In certain of the embodiments discussed above, pitch of individual seat row beams 260*a*, 260*b* and their associated passenger seats 163 may be controlled in both a forward and a backward motion by forcing rotation of seat row beam hangers 600 on each seat row beam's ends relative to floor, if seat row beam hangers 600 are present.

In a further embodiment, referring now generally to FIGS. 7-10, an immersive theater experience for an immersive theater system may be provided by using the system controller to command the rotate actuators 40, pitch actuators 28, and lift actuators 22 to position the seat actuator to a first position; controlling left and right lift arm rotator arms 32 via their associated actuators 40 to effect a motion between each lift arm 20 and its associated rotator arm 32 to adjust an angular relationship between the two by adjusting the angular relationship between a first lift arm lowered position to a second lift arm raised show position (FIGS. 7-10); and, rather than pivoting seat row beams 161 and their associated passenger seats 162 with a rotating floor, altering mutual positions of seat row beams 161 and their associated passenger seats 162 relative to one another while a lift function is taking place with respect to lift arms 20 such that a rotate function brings a second set of seat row beams 161 of seat row beams 161 and its associated passenger seats 162 up and over a second set of seat row beams 161 and its associated passenger seats 162, thereby allowing control over mutual row position during lift and during a show. The rotate function provided by rotator arms 32 may be used to allow the sets of seat row beams 161 and their associated passenger seats 162 to flatten out, front to back, in order to "hop" over a lower theater screen or wall during lift and achieve a predetermined final vertical relationship once past that hurdle.

In addition, a second function may be performed to alter mutual positions of the sets of the seat row beams 161 and their associated passenger seats 162 relative to one another while the lift function is taking place.

As with other methods, where floor 101 (FIG. 13) further comprises nesting slot 105 configured to accept seat row beam 161, seat row beam 161 may be nested or otherwise received into nesting slot 105 in a first position, thereby hiding seat row beam 161 from audience view while in a lowered load/unload first position.

In addition, pitch of individual seat row beams 161 and their associated passenger seats 162 may be controlled, typically in both forward and backward directions, by forcing rotation of seat row beam hangers 31 on each seat row beam's ends relative to facility floor 101. This is typically accomplished using system controller 70, 201, 202 and may be further in conjunction with projectors 103 such as during a show.

Other functions may be controlled as well. By way of example and not limitation, a surge front to back translation may be imparted while lift arms 20 are in a raised show position by combining the motions of lift and rotate. By way of further example and not limitation, the pitch function be used to maintain passenger seats 162 at a predetermined position with positive and negative pitch available in the raised show position.

As described herein, in embodiments the first and second lift arms, e.g. 20, have a pivotal joint with a passenger seat beam rotator which is controlled by one or more, preferably linear, actuators or rotary motors. The action of these actuators/motors is between the arms and their associated passenger seat beam rotator, adjusting the angular relationship between the two.

Though no cables are involved, the theater seating assembly described herein still employs seating that is suspended, by way of the seat beams to which each passenger seat is attached. In embodiments, as also described herein, the theater seating assembly can provide controlled pitch of individual seat rows, both forward and backward, such as by forcing rotation of the hangers on each seat row beam's ends. This rotation is relative to the facility floor, and not the lift arm or rotator. Most embodiments are agnostic of seating type placed upon its beams. For example, it can support individual or banks of motion-seat support base seats or rows of static seats having no further motion.

The foregoing disclosure and description of the inventions are illustrative and explanatory. Various changes in the size, shape, and materials, as well as in the details of the illustrative construction and/or an illustrative method may be made without departing from the spirit of the invention.

What is claimed is:

1. A theater system, comprising:

a. a theater housing;

b. a theater seating assembly disposed at least partially within the theater housing, the theater seating assembly comprising:

i. a seat support base;

ii. a first seat support, comprising:

1. a first lift arm pivotally connected to the seat support base;
2. a first lift arm actuator operatively connected to the first lift arm;
3. a first passenger seat beam rotator operatively connected to the first lift arm distally from the seat support base; and
4. a first passenger seat beam rotator actuator operatively connected to the first passenger seat beam rotator, the first passenger seat beam rotator actuator operative to effect a change in passenger seat row pitch independently of rotation of the first lift arm;

iii. a second seat support disposed distally from the first seat support in a mirror configuration with respect to a seat axis defined by a longitudinal distance between the first seat support and the second seat support, comprising:

1. a second lift arm pivotally connected to the seat support base; and
2. a second lift arm actuator operatively connected to the second lift arm and configured to coordinate movement of the second lift arm with the first lift arm;
3. a second passenger seat beam rotator operatively connected to the second lift arm; and
4. a second passenger seat beam rotator actuator operatively connected to the second passenger seat beam rotator distally from the seat support base, the second passenger seat beam rotator actuator operative to effect a change in passenger seat row pitch independently of rotation of the second lift arm cooperatively with the first passenger seat beam rotator actuator;

iv. a passenger seat assembly operatively connected to the first passenger seat beam rotator and to the second passenger seat beam rotator, the passenger seat assembly disposed substantially parallel to the seat axis, the passenger seat assembly comprising a passenger seating area; and v. a system controller operatively in communication with the first lift arm actuator, the second lift arm actuator, the first passenger seat beam rotator actuator, and the second passenger seat beam rotator actuator, the system controller operative to coordinate movement of the first lift arm and the second lift arm in their respective X-Y planes while simultaneously effecting a change to the pitch angle; and c. an audiovisual projector operatively in communication with the system controller.

2. The theater system of claim 1, wherein a predetermined portion of the passenger seat assembly extends outward and through an aisle area on each side of the passenger seat assembly into left and right equipment spaces where they then attach to the rotators.

3. The theater system of claim 1, wherein the housing further comprises a floor, a portion of the floor elevated with respect to a predetermined portion of the passenger seat assembly to promote shielding of dropped objects from an upper passenger seating area of the passenger seat assembly to a lower passenger seating area of the passenger seat assembly.

4. The theater system of claim 1, further comprising a fixed canopy disposed over each passenger seating area of the passenger seat assembly which moves with its associated passenger seating area.

5. A method of providing a theater experience using a theater system comprising a theater housing; a theater seating assembly disposed at least partially within the theater housing, the theater seating assembly comprising a seat support base; a first seat support, comprising a first lift arm pivotally connected to the seat support base; a first lift arm actuator operatively connected to the first lift arm; a first passenger seat beam rotator operatively connected to the first lift arm distally from the seat support base; and a first passenger seat beam rotator actuator operatively connected to the first passenger seat beam rotator, the first passenger seat beam rotator actuator operative to effect a change in passenger seat row pitch independently of rotation of the first lift arm; a second seat support disposed distally from the first seat support in a mirror configuration with respect to a seat axis defined by a longitudinal distance between the first seat support and the second seat support, comprising a second lift arm pivotally connected to the seat support seat support base; and a second lift arm actuator operatively connected to the second lift arm and configured to coordinate movement of the second lift arm with the first lift arm; a second passenger seat beam rotator operatively connected to the second lift arm; and a second passenger seat beam rotator actuator operatively connected to the second passenger seat beam rotator distally from the seat support base, the second passenger seat beam rotator actuator operative to effect a change in passenger seat row pitch independently of rotation of the second lift arm cooperatively with the first passenger seat beam rotator actuator; a passenger seat assembly operatively connected to the first passenger seat beam rotator and to the second passenger seat beam rotator, the passenger seat assembly disposed substantially parallel to the seat axis, the passenger seat assembly comprising a passenger seating area; and a system controller operatively in communication with the first lift arm actuator, the second lift arm actuator, the first passenger seat beam rotator actuator, and the second passenger seat beam rotator actuator, the system controller operative to coordinate movement of the first lift arm and the second lift arm in their respective X-Y planes while simultaneously effecting a change to the pitch angle; and an audiovisual projector operatively in communication with the system controller, the method comprising:

a. positioning the first lift arm and the second lift arm and rotating the passenger seat assembly to a passenger boarding position sufficient to allow a passenger to sit in the passenger seat assembly;

b. allowing a passenger to board the passenger seat assembly;

c. using the system controller to substantially synchronously control the first lift arm and the second lift arm via their associated arm actuators to effect a motion of each arm with respect to the seat support base by adjusting an angular relationship between a first lift arm lowered position to a second lift arm raised position at a first predetermined set of times; and d. using the system controller to substantially synchronously control the first passenger seat beam rotator and the second passenger seat beam rotator via their associated passenger seat beam rotator actuators to adjust an angular relationship between the first lift arm and the second lift arm and their associated passenger seat beam rotators rather than pivoting the passenger seat assembly with a rotating floor.

6. The method of providing an immersive theater experience of claim 5, wherein altering positions of the passenger seat assembly occurs while a raising and lowering function is taking place.

7. The method of providing an immersive theater experience of claim 5, wherein the floor further comprises a nesting slot configured to accept a seat row beam therein, the method further comprising nesting the seat row beam into the nesting slot in a first position, thereby hiding the seat row beam from audience view while in the first lift arm lowered position.

8. The method of providing an immersive theater experience of claim 5, further comprising coordinating movement of the first seat support, the second seat support, and rotation of the passenger seat assembly with the audiovisual projector.

9. The method of providing an immersive theater experience of claim 5, further comprising imparting a surge translation while the first lift arm and the second lift arm are in a raised show position by combining the motions of lift and rotate.

10. The method of providing an immersive theater experience of claim 5, further comprising using a pitch function to maintain the passenger seat assembly at a predetermined position with positive and negative pitch available in the raised show position.

11. The method of providing an immersive theater experience of claim 10, further comprising performing a second function to alter mutual positions of the first seat beam and the second seat beam and their associated passenger seats relative to one another while a lift function is taking place.

12. The method of providing an immersive theater experience of claim 10, further comprising controlling pitch of the first seat beam and the second seat beam and their associated passenger seats by forcing rotation of their respective passenger seat beam rotators relative to the facility floor.

13. The method of providing an immersive theater experience of claim 5, wherein the passenger seat assembly comprises a first seat beam operatively connected to the first passenger seat beam rotator at a first end of the first passenger seat beam rotator and to the second passenger seat beam rotator at a corresponding first end of the second passenger seat beam rotator substantially parallel to the seat axis and a second seat beam operatively connected to the first passenger seat beam rotator at a second end of the first passenger seat beam rotator distally from the first end and the second passenger seat beam rotator at a corresponding second end of the second passenger seat beam rotator substantially parallel to the first seat beam, the method further comprising controlling a rotate function of the passenger seat beam rotator actuators to bring the first seat beam and its associated passenger seats up and over the second seat beam and its associated passenger seats, thereby allowing control over mutual row position during lift and during a show.

14. The method of providing an immersive theater experience of claim 13, further comprising using the rotate function to allow the first seat beam and the second seat beam and their associated passenger seats rows to flatten out, front to back, in order to traverse over a lower theater screen or wall during lift and achieve a predetermined final vertical relationship once the lower theater screen or wall has been traversed.

* * * * *